US008542083B2

(12) United States Patent
Maloney

(10) Patent No.: US 8,542,083 B2
(45) Date of Patent: Sep. 24, 2013

(54) COLLAPSIBLE MECHANISM FOR CIRCUIT BREAKERS

(75) Inventor: James Gerard Maloney, Industry, PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 13/243,950

(22) Filed: Sep. 23, 2011

(65) Prior Publication Data

US 2013/0076461 A1 Mar. 28, 2013

(51) Int. Cl.

| | |
|---|---|
| ***H01H 75/00*** | (2006.01) |
| ***H01H 77/00*** | (2006.01) |
| ***H01H 83/00*** | (2006.01) |
| ***H01H 9/20*** | (2006.01) |
| ***H01H 9/00*** | (2006.01) |

(52) U.S. Cl.
USPC ..... 335/167; 335/6; 335/172

(58) Field of Classification Search
USPC ..... 335/6, 172, 167, 35
See application file for complete search history.

(56) References Cited

U.S. PATENT DOCUMENTS

| | | | | |
|---|---|---|---|---|
| 4,604,596 | A * | 8/1986 | Yokoyama et al. | 335/14 |
| 4,825,183 | A * | 4/1989 | Hauschildt | 335/167 |
| RE33,325 | E * | 9/1990 | Yokoyama et al. | 335/14 |
| 5,258,733 | A * | 11/1993 | Link et al. | 335/172 |
| 5,381,120 | A * | 1/1995 | Arnold et al. | 335/35 |
| 5,469,121 | A * | 11/1995 | Payet-Burin | 335/16 |
| 5,831,499 | A * | 11/1998 | Batteux et al. | 335/9 |
| 6,034,586 | A * | 3/2000 | Runyan et al. | 335/172 |
| 6,054,912 | A * | 4/2000 | Kaneko et al. | 335/172 |
| 6,225,881 | B1 * | 5/2001 | Felden et al. | 335/172 |
| 6,239,676 | B1 * | 5/2001 | Maloney et al. | 335/6 |
| 6,239,677 | B1 * | 5/2001 | Ramakrishnan et al. | 335/35 |
| 6,407,653 | B1 * | 6/2002 | Zindler et al. | 335/6 |
| 6,420,948 | B1 * | 7/2002 | Runyan | 335/6 |
| 7,986,203 | B2 * | 7/2011 | Watford | 335/10 |
| 2002/0171519 | A1 * | 11/2002 | Lanning et al. | 335/172 |
| 2003/0197581 | A1 * | 10/2003 | O'Keeffe et al. | 335/172 |

OTHER PUBLICATIONS

Eaton Corporation, "Breaker Basics", Section 4, General Information, 1992, p. 8.

Eaton Corporation, "Breaker Basics" Section 3 Introduction, 1992, p. 6.

* cited by examiner

*Primary Examiner* — Alexander Talpalatski

(74) *Attorney, Agent, or Firm* — Jaquez & Associates; Martin J. Jaquez, Esq.; Alessandro Steinfl, Esq.

(57) ABSTRACT

A device can be installed inside a circuit breaker assembly to reduce friction between an armature and a cradle, which in turn, allows the circuit breaker to trip without requiring significant force. Such device can be a collapsible mechanism configured to swivel about its hinged connection to the armature.

4 Claims, 7 Drawing Sheets

COLLAPSIBLE MECHANISM FOR CIRCUIT BREAKERS

FIELD

The present disclosure relates to a mechanism for tripping a circuit breaker with minimal force. Moreover, it relates to a collapsible mechanism for circuit breakers.

BACKGROUND

A circuit breaker is defined by National Electrical Manufacturers Association (NEMA) standards as a device designed to open and close a circuit by non-automatic means, and to open the circuit automatically on a predetermined overcurrent, without injury to itself when properly applied within its rating. A circuit breaker is also defined in American National Standards Institute (ANSI) standards as a mechanical switching device, capable of making, carrying and breaking currents under normal circuit conditions and also, making, carrying for a specified time and breaking currents under specified abnormal circuit conditions such as those of short-circuit.

There are two classifications and three types of circuit breakers used in low voltage circuit protection. The two basic classes of circuit breakers are: Low Voltage Power Circuit Breaker Class, and Molded Case Circuit Breaker Class. The three types of circuit breakers are: Low Voltage Power Circuit Breakers (LVPCB), Molded Case Circuit Breakers (MCCB), and Insulated Case (encased) Circuit Breakers (ICCB). Molded case circuit breakers are designed to provide circuit protection for low voltage distribution systems. They protect connected apparatus against overloads and/or short circuits.

The need for molded case circuit breakers was created in 1918 when numerous applications for electrical motors resulted in a demand for a device that would ensure safe operation and, at the same time, protect electrical circuits. During this period, individual motors were used for the first time in industrial plants to operate machine tools, and in private homes to operate appliances. Plant electricians were constantly changing fuses blown during motor start-ups because of the lack of properly designed fuses for motor circuit protection. Homes experienced similar problems when electrical circuits were overloaded. Inspectors were concerned about fire hazards, because of plug fuses being bridged with pennies and the installation of fuses with too high of an ampere rating. Inspection authorities became involved and attempted to find a solution to the problem. Meetings with switch manufacturers were initiated in an effort to find a solution. Switch manufacturers were asked to develop a switching device that would interrupt a circuit under prolonged overload conditions. The device would have to be safe, reliable and tamperproof. It should also be resettable so as to be reusable after an interruption without replacing any parts. This search for better circuit protection resulted in many different but unacceptable approaches to the problem. These early meetings and subsequent efforts prepared the groundwork for the eventual development of the molded case circuit breaker.

SUMMARY

According to a first aspect, a mechanism for circuit breakers is described, the mechanism comprising: a housing with a circuit breaker assembly configured to trip upon presence of one or more trip conditions; a plurality of trip condition sensing elements adapted to detect the one or more trip conditions; an armature connected with the plurality of the trip condition sensing elements, the armature having a first end and a second end, the first end pivotally connected with the housing such that the armature is adapted to pivotally move upon detection of the one or more trip conditions; and a collapsible link hingedly connected with the second end of the armature, the collapsible link adapted to swingably collapse upon detection of the one or more trip conditions, thereby causing the circuit breaker to trip.

According to a second aspect, a collapsible link for a circuit breaker is described, the link comprising: a flat substantially oval shaped rigid structure having a first rounded end and a second rounded end, the first rounded end adapted to be hingedly connected with a further structure, the flat substantially oval shaped rigid structure adapted to rotate about a hingedly connected pivot point; a torsion spring adapted to maintain the flat substantially oval shaped rigid structure in a default position; and a notch structure protruding from the second rounded end, the notch structure adapted to receive an angular force from a device configured to cause the collapsible link to rotate.

According to a third aspect, a plurality of circuit breakers is described, the circuit breakers comprising the mechanism according to the first aspect.

BRIEF DESCRIPTION OF DRAWINGS

The accompanying drawings, which are incorporated into and constitute a part of this specification, illustrate one or more embodiments of the present disclosure and, together with the description of example embodiments, serve to explain the principles and implementations of the disclosure.

DETAILED DESCRIPTION

Three different conditions of a circuit breaker are described in the present disclosure. An element number followed by a hyphenated number "1" is intended to indicate the location, condition, and/or position of a particular element in its ON state; a hyphenated number "2" is intended to indicate an OFF state; and a hyphenated number "3" is intended to indicate a tripped and unlatched condition. An element number without a hyphenated suffix is intended to indicate an element that is not necessarily in an ON, OFF, or tripped condition. The terms "latched" and "charged" can be used interchangeably, and the terms "unlatched" and "tripped" can be used interchangeably herein in the present disclosure.

The circuit breaker in an ON state is considered to be in a condition that allows current to flow through the circuit breaker from a first end to a second end (e.g., line end terminal to collar; input end to output end), and the tripping elements (which will be described later) are charged, such that if a trip condition becomes present, the circuit breaker will trip. An OFF state is considered to be a condition where the circuit breaker acts as an open circuit such that the current is unable to flow through the circuit breaker. Additionally, if a trip condition becomes present, the circuit breaker will still trip. A tripped and unlatched state is considered to be a condition where the circuit breaker acts as an open circuit as a consequence of a trip condition. As a result of the open circuit, current is also unable to flow through the circuit breaker.

Figure 1A:
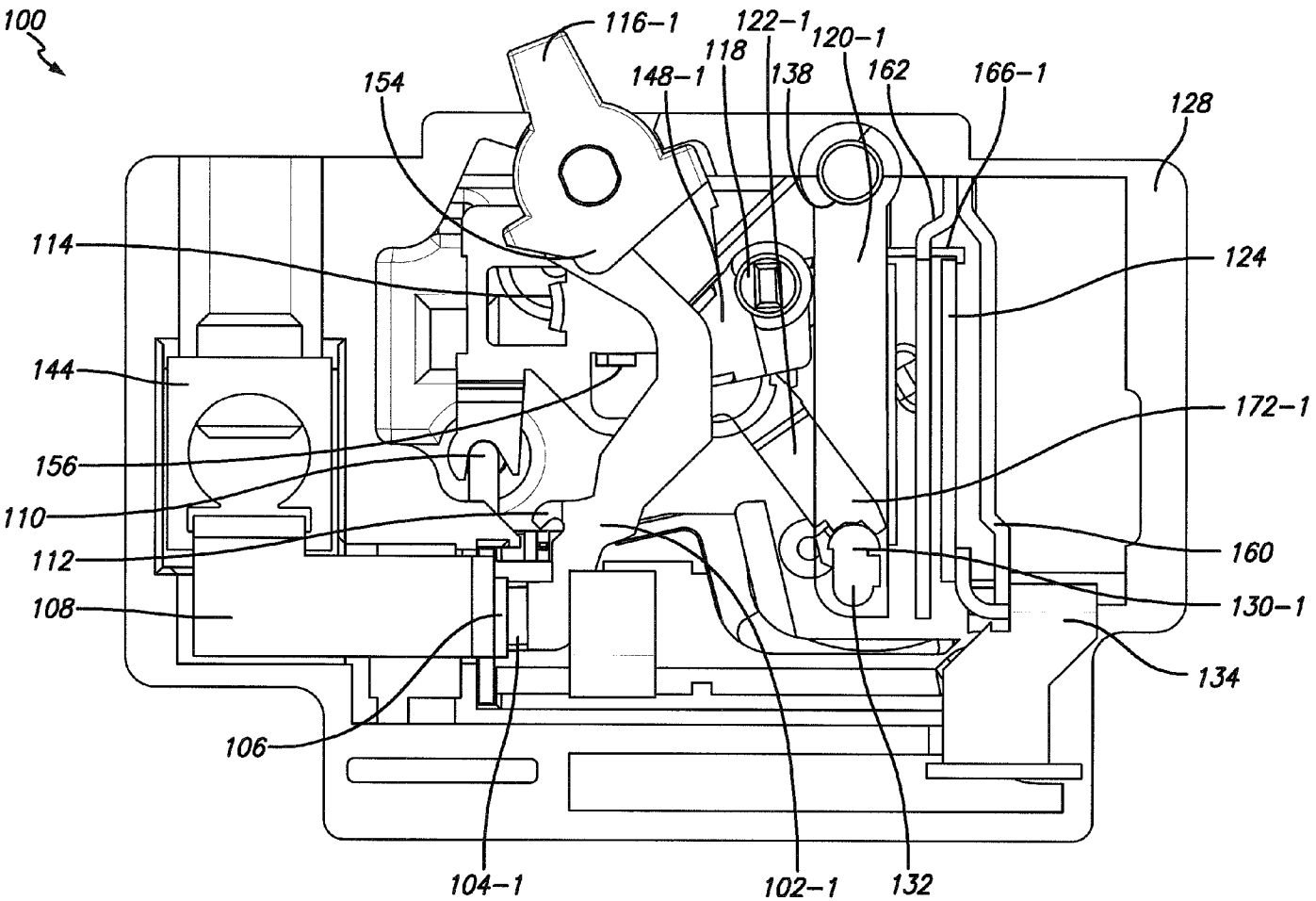
FIGS. 1A-1B show cross-sectional views of a circuit breaker in an ON and latched configuration.
Figure 1B:
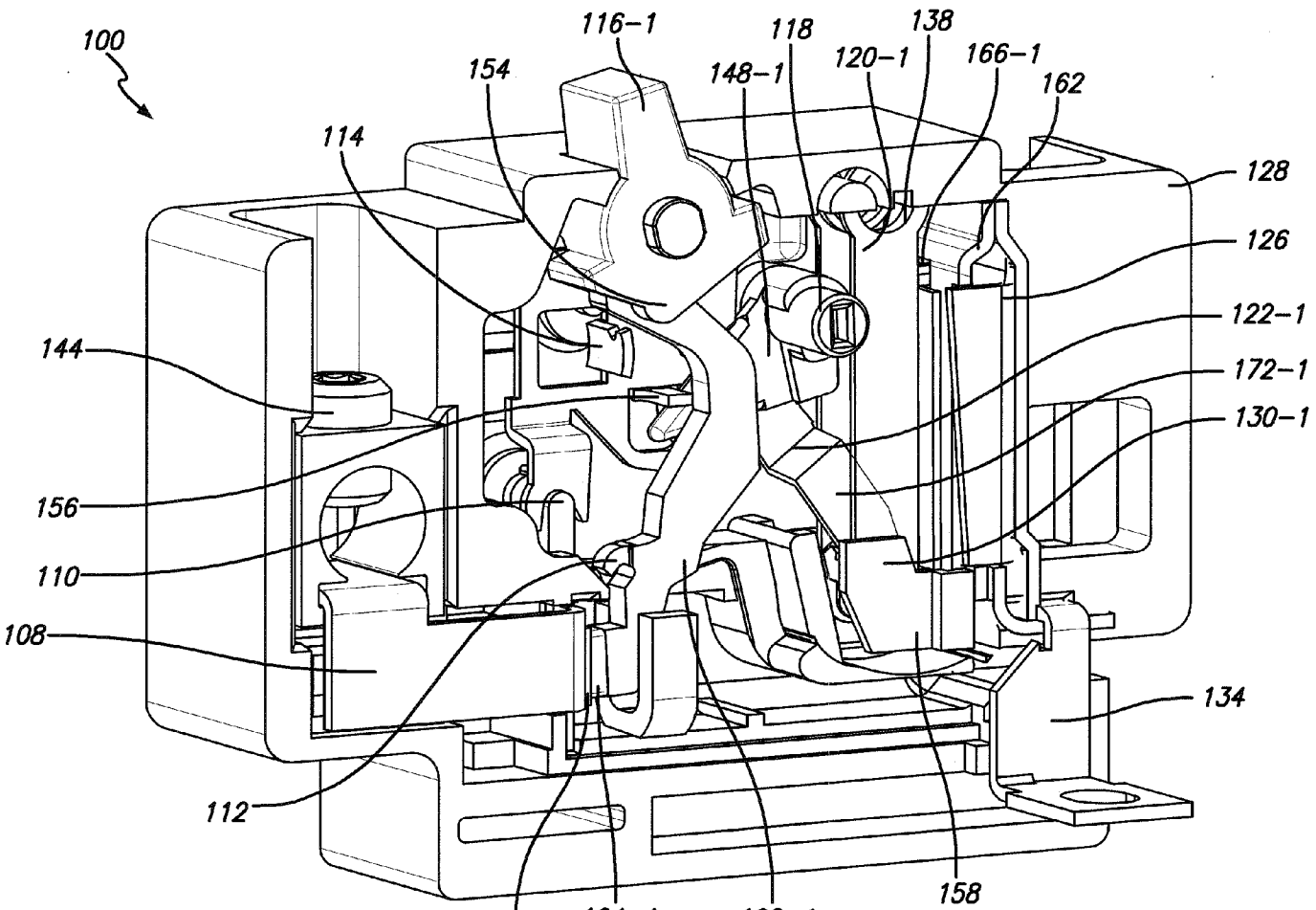

FIGS. 1A-1B show cross-sectional views of a cased circuit breaker (100), e.g., a molded case circuit breaker, in an ON configuration and housed in a casing (128), e.g., plastic casing. In the ON configuration, a movable contact (104-1) attached to a movable arm (102-1) on one side, is connected to a stationary contact (106) on the other side. The movable contact (104-1) and the stationary contact (106) complete an electrical circuit to enable current to flow from a line end terminal (134), through a first conductor (160), a second conductor (162), a shunt bracket (158), two shunts (not shown), the movable arm (102), the movable contact (104-1), the stationary contact (106-1), a third conductor (108), and finally, to a collar (e.g., aluminum collar) (144). The movable arm (102-1) is hingedly connected to an operating handle (116-1) at a movable arm pivot point (154) of the operating handle (116-1). The operating handle (116-1) can be moved to an ON or OFF position by an operator through action on the top portion of the operating handle (116-1). A cradle (122-1) is pivotally connected to a cradle pivot point (110) and also rests on a collapsible link (103-1). A spring (not shown) is connected between a first notch (114) on the cradle (122-1) and a third notch (112) on the movable arm (102-1). A second notch (156) on the cradle (122-1) is configured to push the movable arm (102-1) from an ON position to an OFF position. One trip cam (148) is layered next to another trip cam, and hingedly connected at the trip cam pivot point (118), whereby each trip cam is associated with each pole of the electric circuit.

With continued reference to FIGS. 1A-1B, an armature (120-1) is pivotally connected to the plastic casing (128) and extends toward a lower region of the plastic casing (128). The armature (120-1) is adapted to pivot about an armature pivot point (138) such that a lower portion of the armature (120-1) can move from side to side. An inducible magnetic element (126) is positioned adjacent to the first conductor (160) or the second conductor (162), such that when current flows through the first conductor (160) or the second conductor (162), the current induces a magnetic field on the inducible magnetic element (126). The induced magnetic field is adapted to attract the armature (120-1). A bimetal (124) is positioned between the first conductor (160) and the second conductor (162), such that when the temperature of the circuit breaker rises, the bimetal bends and deflects away from the armature (120-1). The armature (120-1) has a finger (166) which protrudes over the bimetal (124) such that the bimetal (124) hooks the finger (166) as it deflects.

Opposite the armature pivot point (138) end at an end of the armature (120-1), is a hingedly connected collapsible link (130-1) (also shown in FIG. 4) adapted to pivot about a spring loaded hinge (132) that connects the collapsible link (130-1) to the armature (120-1). By way of example and not of limitation, the spring can be a torsion spring, such that the default position of the collapsible link (130) is in the latched position. Thus, if the collapsible link (130) is in the unlatched position, and there are no other forces applied on the collapsible link (130) to maintain the unlatched position, then the spring loaded hinge (132) will cause the collapsible link (130) to return to the latched position. The collapsible link (130-1) forms a friction joint (170) with the cradle (122-1) that rests over the collapsible link (130). The collapsible link (130) can be shaped substantially elliptically, having an upper link (168-1). The collapsible link (130-1) can be configured such that when the armature (120-1) is in the ON position, a substantially vertical force vector (172-1) is applied on the collapsible link (130-1), thereby keeping the collapsible link (130-1) in an upright position (ON position). The upper link (168-1) is attached to the collapsible link (130-1) such that if the angle of the force vector (172-1) changes from a substantially vertical vector (174-1 in FIG. 4) to a slightly angled vector (174-2 in FIG. 4), then the collapsible link (130-1) will turn (e.g. collapse) counterclockwise. The force vector (172-1) angle changes from the substantially vertical vector (174-1) to a slightly angled vector (174-2) as a consequence of the movement of the armature (120). The angled force vector (174-2) can be applied to the upper link (168-1), thereby further causing the collapsible link (130-1) to turn.

Figure 2A:
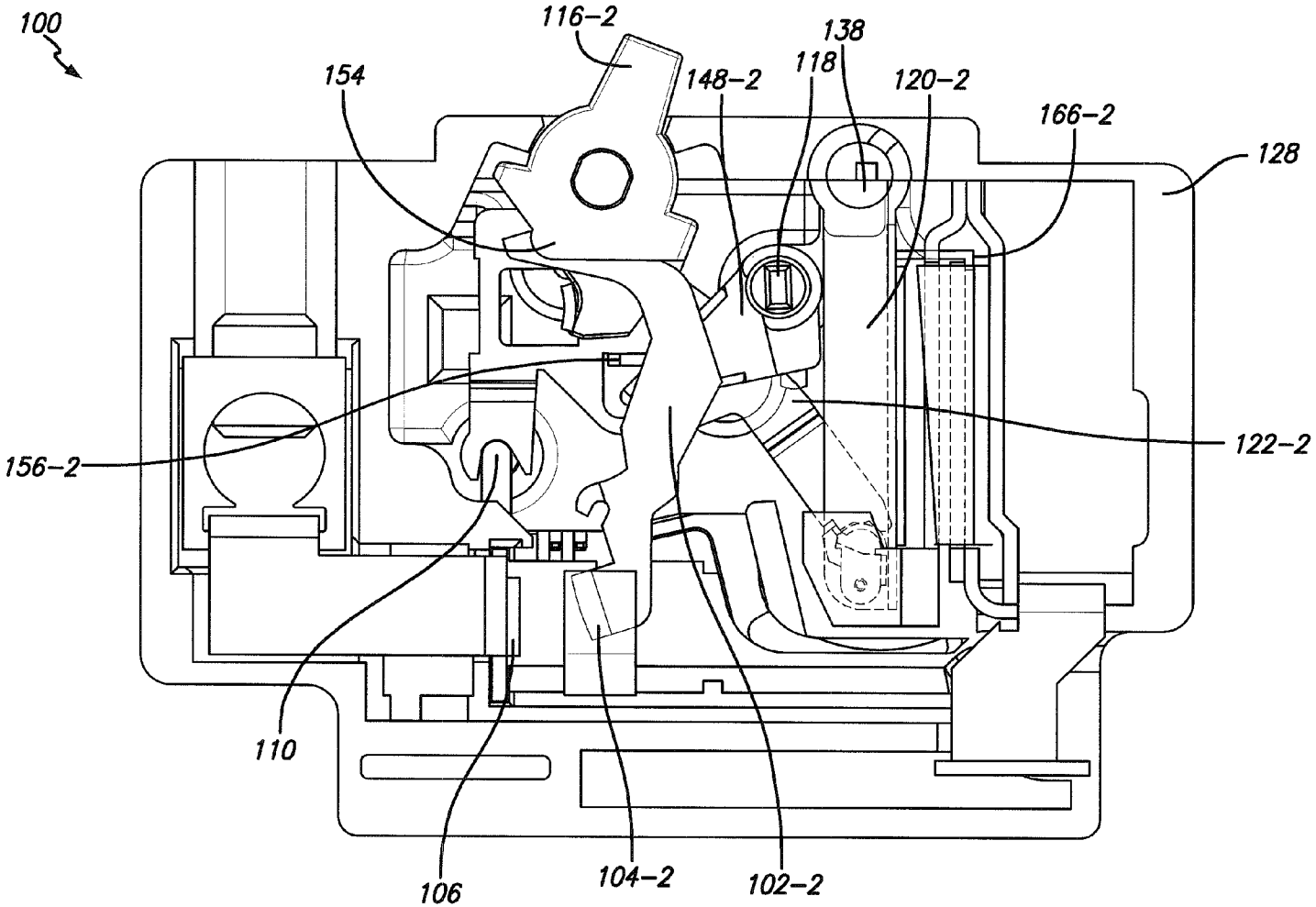
FIGS. 2A-2B show cross-sectional views of a circuit breaker in an OFF and latched configuration.
Figure 2B:
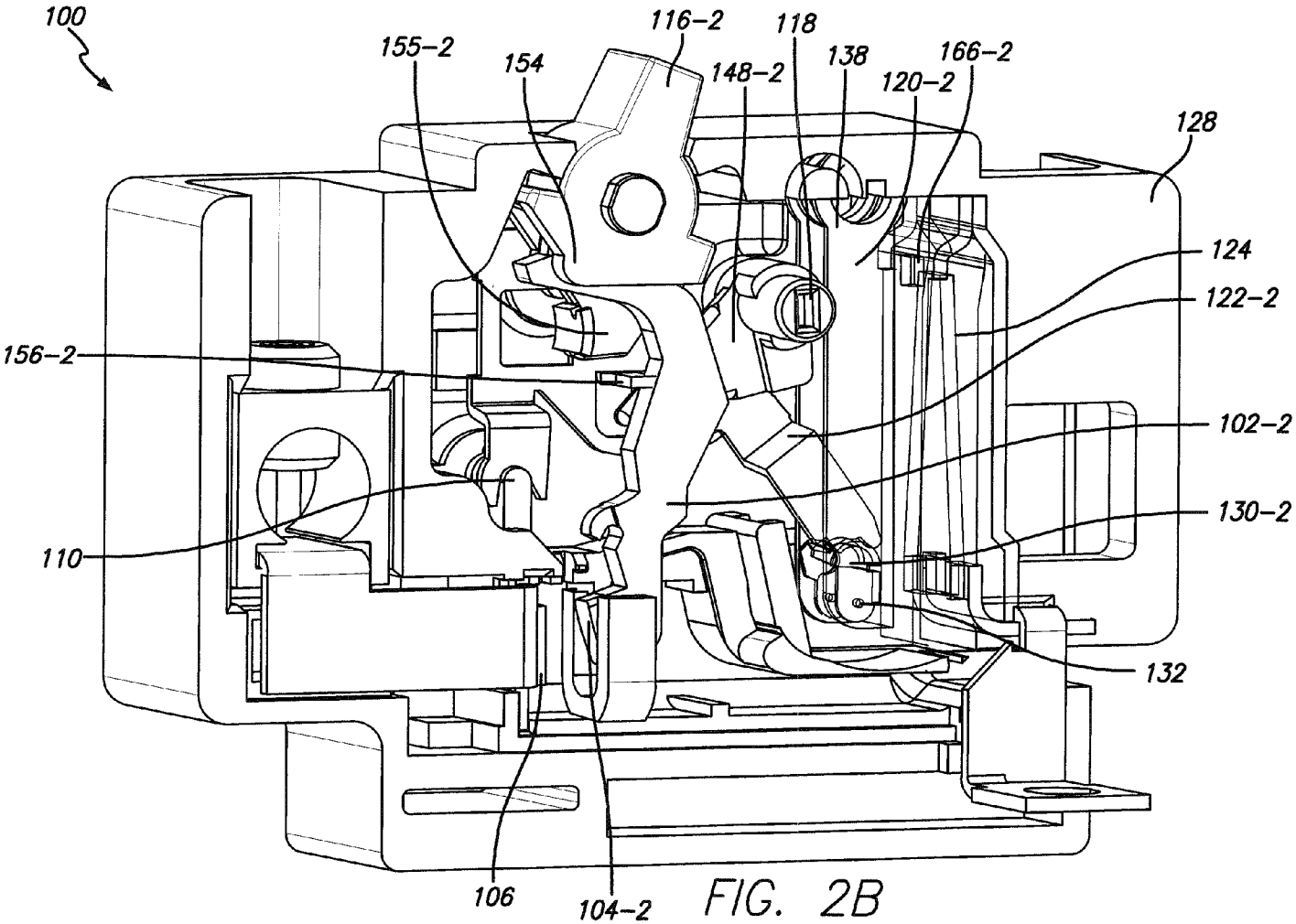

FIGS. 2A-2B show cross-sectional views of the molded case circuit breaker (100) in an OFF (and latched/untripped) configuration and housed in a plastic casing (128). In the OFF position, the movable arm (102-2) is rotated slightly in a counterclockwise direction about the movable arm pivot point (154). As a result, the movable contact (104-2) moves away from the stationary contact (106) and is separated from the stationary contact (106), thereby opening the circuit and stopping current flow through the circuit breaker (100). The armature (120-2), collapsible link (130-2), bimetal (124) are all in the same position as in the ON configuration as described.

Figure 3A:
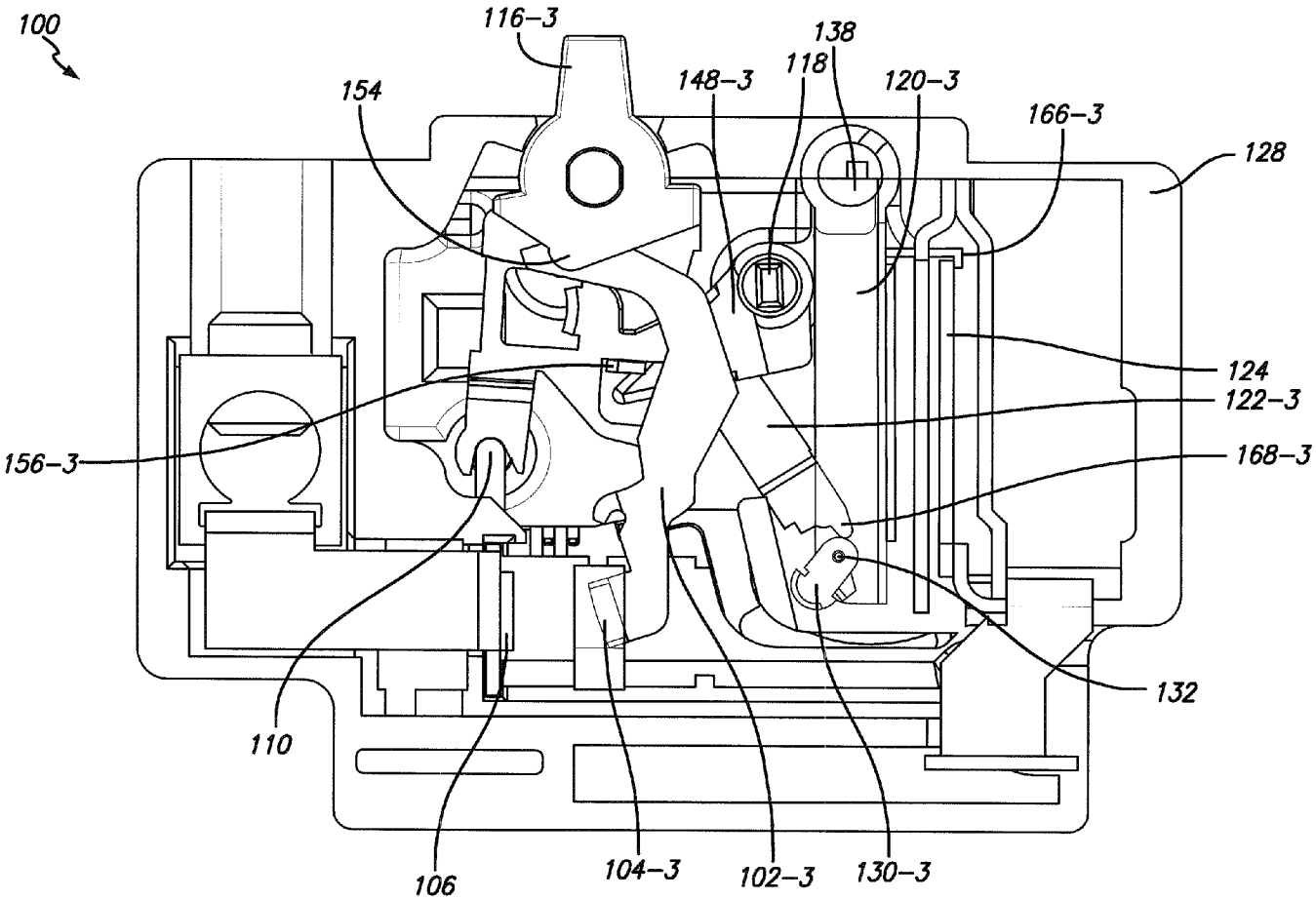
FIGS. 3A-3B show cross-sectional views of a circuit breaker in a tripped and unlatched configuration.
Figure 3B:
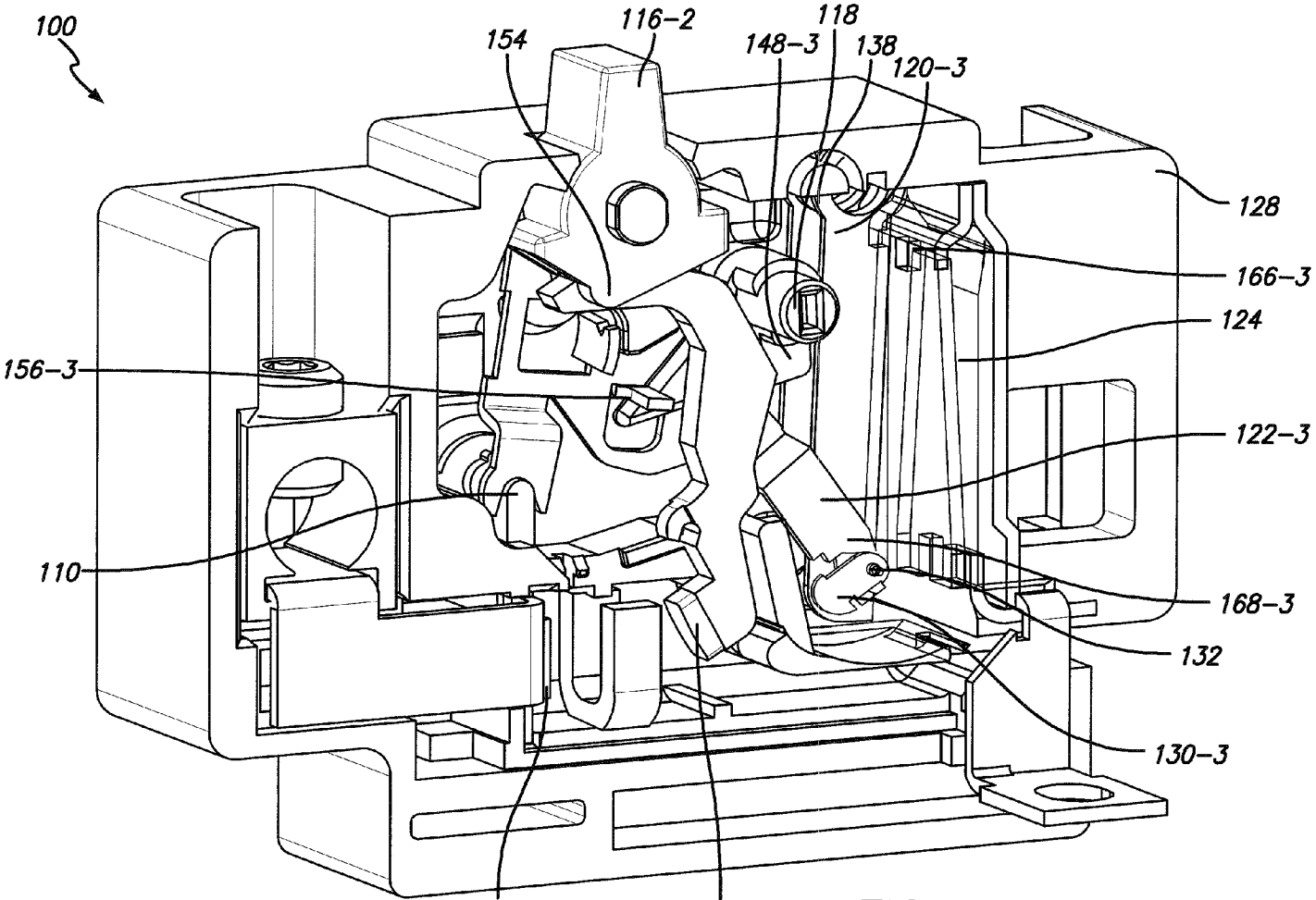

FIGS. 3A-3B show cross-sectional views of a molded case circuit breaker (300) in a tripped configuration and housed in a plastic casing (128). In the tripped position, the movable arm (102-3) is also rotated slightly in a counterclockwise direction about the movable arm pivot point (154). As a result, the movable contact (104-3) again, moves away from the stationary contact (106) and is separated from the stationary contact (106), thereby opening the circuit and stopping current flow through the circuit breaker (200). In the tripped position, the armature (120-3) is pivoted about the armature pivot point (138) in the direction of the bimetal (124-3), and the collapsible link (130-3) has hingedly pivoted about the collapsible link pivot point (132). With the collapsible link (130-3) in such tripped position, the lower end (168-3) of the cradle (122-3) is lowered, such that the entire cradle (122-3) is rotated in a clockwise direction about the cradle pivot point (110).

With the circuit breaker (100) in the ON configuration, the stationary contact (106) and the movable contact (104-1) in the circuit breaker (100) are closed, thereby electrically completing the circuit to allow current to flow from the line end terminal (134) to the third conductor (108). When it is desired to switch the circuit breaker OFF by opening/separating the stationary contact (106) and the movable contact (104-1), an operator can move the operating handle (116-1) from the ON position (as shown in FIG. 1A) to the OFF position (as shown in FIG. 2A as 116-2). As the operating handle (116-1) is moved from the ON position to the OFF position, the lower portion of the operating handle (155-2) comes in contact with the first notch (114) of the cradle (122-1), which causes the cradle (122-1) to pivot about the cradle pivot point (110) in a clockwise direction. As the cradle (122-1) turns in a clockwise direction, the second notch (156-1) of the cradle (122-1) comes in contact with the movable arm (102-1), which in turn, along with the force from the spring (not shown) that is connected between the first notch (114) and the third notch (112), causes the movable arm (102-1) to pivot about the movable arm pivot point (154) in a counter clockwise direction, causing the movable contact (104-1) to separate from the stationary contact (106).

For the case where the circuit breaker is operated from an ON configuration to an OFF configuration, the armature (120-1) and the collapsible link (130-1) remain unaffected and stationary. Therefore, the circuit breaker remain charged such that the operating handle (116-2) can be repositioned from the OFF position to the ON position to close the movable contact (104-2) and allow the current to flow through the circuit breaker again.

With the circuit breaker (100) now in the OFF configuration, the stationary contact (106) and the movable contact (104-2) in the circuit breaker (100) are separated, thus the circuit breaker (100) is in an open electrical circuit condition, preventing current from flowing through the circuit breaker (100). When it is desired to turn the circuit breaker (100) ON to allow current to flow through the circuit breaker (100), an operator can move the operating handle (116-2) from the OFF position (as shown in FIG. 2) to the ON position (as shown in FIG. 1). As a consequence of the force vector from the spring (not shown) connected between the first notch (114) and the third notch (112), the movable arm (102-2) pivots in a clockwise direction to close the movable contact (104-2) to the stationary contact (106).

Similar to the case where the circuit breaker is operated from the ON configuration to the OFF configuration, when the circuit breaker is operated from the OFF configuration to the ON configuration, the armature (120-1) and the collapsible link (130-2) remain unaffected and stationary. Therefore, the circuit breaker remains charged and the operating handle (116-1) can be repositioned again from the ON position to the OFF position while maintaining a charged circuit breaker.

From either the ON configuration or the OFF configuration, the circuit breaker can be configured to trip and unlatch when a trip condition such as an overcurrent condition is sensed by the circuit breaker. By way of example and not of limitation, such overcurrent condition can cause the conductive elements inside the circuit breaker (100) to rise in temperature or induce a larger than normal magnetic field.

More specifically, in the case of thermal response to an overcurrent condition, the bimetal (124) is configured to bend as the temperature inside the circuit breaker housing change. By way of example and not of limitation, a low expansion thermostatic metal can be cold bonded to a high expansion nickel-chrome steel alloy, thereby providing a highly reliable thermal element. As the temperature rises, a top portion of the bimetal can begin to deflect away from the armature (120). As the bimetal (124) deflects, the bimetal (124) hooks the finger (166), thereby causing the armature (120) to pivot about the armature pivot point (138) in a counterclockwise direction. As the armature (120) pivots, the lower section of the armature moves toward the bimetal (124). Simultaneously, the upper link member (168) of the collapsible link (130) that is hingedly connected to the bottom of the armature (120) begins to rotate in a counterclockwise direction. The rotation of the collapsible link (130) releases the armature end of the cradle (172) from the latched position, thereby unlatching the cradle (122). As the cradle (122) becomes unlatched, the cradle (122) pivots about the cradle pivot point (110) which changes the angle of the force from the spring (not shown) connected between the first notch (114) on the cradle to the third notch (112) on the movable arm (102), thereby causing the movable arm (102) to pivot about the movable arm pivot point (154). Consequently, with the movable arm (102) connected to the movable contact (104), the movable contact (104) separates from the fixed contact (106), thus electrically opening the current flow path in the circuit breaker (100). Simultaneously, the trip cam (148) rotates, thereby pushing the armature (120) to cause the remaining poles to also trip. The resulting configuration of the circuit breaker is now in a tripped condition.

Alternatively, in the case of a magnetic response, as the inducible magnetic element (126) becomes induced with magnetic field, for example, as a consequence of the overcurrent condition, the armature (120) can be magnetically attracted toward the inducible magnetic element (126), thereby pivotally moving the armature (120). Such movement of the armature (120) in turn, causes the collapsible link (130) to rotate in a counterclockwise direction as described in the previous paragraph. The rotation of the collapsible link (130) releases the armature end of the cradle (172) from the latched position, thereby unlatching the cradle (122). As the cradle (122) becomes unlatched, the cradle (122) pivots about the cradle pivot point (110) which changes the angle of the force from the spring (not shown) connected between the first notch (114) on the cradle to the third notch (112) on the movable arm (102), thereby causing the movable arm (102) to pivot about the movable arm pivot point (154). Consequently, with the movable arm (102) connected to the movable contact (104), the movable contact (104) separates from the fixed contact (106), thus electrically opening the current flow path in the circuit breaker (100). Simultaneously, the trip cam (148) rotates, thereby pushing the armature (120) to cause the remaining poles to also trip. The resulting configuration of the circuit breaker is now in a tripped condition.

Similarly, in the case that the circuit breaker (100) is initially in the OFF configuration, when the overcurrent condition occurs, the same sequence of events as in the case where the circuit breaker (100) is initially in the ON configuration, can take place inside the circuit breaker (100) such that the collapsible link (130) rotates and the cradle (120) becomes unlatched. Since the circuit breaker (100) is already in the OFF configuration, the stationary contact (106) and the movable contact (104) are already separated, thus no current flows through the circuit breaker (100).

Figure 4:
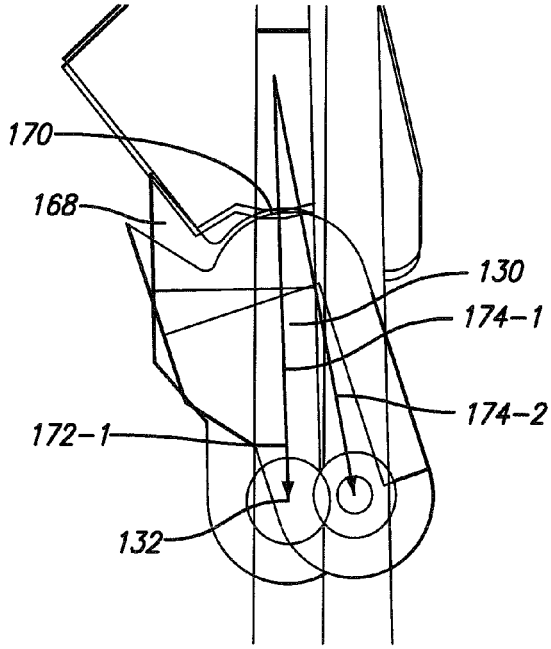
FIGS. 4-5 show close-up views of a collapsible link connected to an armature inside the circuit breaker.
Figure 5:
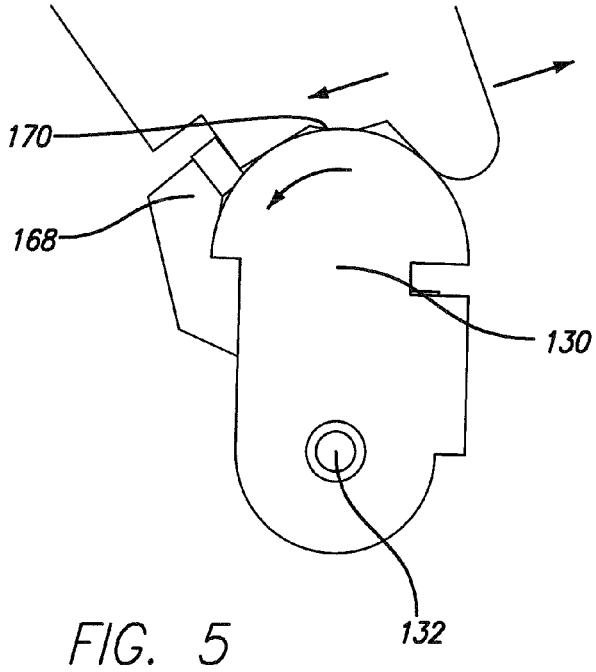

In order to place the circuit breaker (100) in the ON configuration from the tripped and unlatched configuration, the circuit breaker (100) is first latched, by initially moving the operating handle (116) to the OFF position, and then moved to the ON position. By doing so, the movable arm (102) pushes the second notch (156), which in turn, lifts the cradle (122). Once the cradle (122) is lifted away from the collapsible link (130), the torsion spring in the spring loaded hinge (132) forces the collapsible link (130) to return to the latched position, as shown in FIG. 4.

The examples set forth above are provided to give those of ordinary skill in the art a complete disclosure and description of how to make and use the embodiments of the disclosure, and are not intended to limit the scope of what the inventors regard as their disclosure. Modifications of the above-described modes for carrying out the disclosure may be used by persons of skill in the art, and are intended to be within the scope of the following claims.

It is to be understood that the disclosure is not limited to particular methods or systems, which can, of course, vary. It is also to be understood that the terminology used herein is for the purpose of describing particular embodiments only, and is not intended to be limiting. As used in this specification and the appended claims, the singular forms "a," "an," and "the" include plural referents unless the content clearly dictates otherwise. The term "plurality" includes two or more referents unless the content clearly dictates otherwise. Unless defined otherwise, all technical and scientific terms used herein have the same meaning as commonly understood by one of ordinary skill in the art to which the disclosure pertains.

A number of embodiments of the disclosure have been described. Nevertheless, it will be understood that various modifications may be made without departing from the spirit and scope of the present disclosure. Accordingly, other embodiments are within the scope of the following claims.

The invention claimed is:

1. A mechanism for circuit breakers comprising:

a housing with a circuit breaker assembly configured to trip upon presence of one or more trip conditions;

a plurality of trip condition sensing elements adapted to detect the one or more trip conditions;

an armature connected with the plurality of the trip condition sensing elements, the armature having a first end and a second end, the first end pivotally connected with the housing such that the armature is adapted to pivotally move upon detection of the one or more trip conditions; and a collapsible link hingedly connected with the second end of the armature, wherein the collapsible link is oval shaped, and the collapsible link is adapted to swingably collapse upon detection of the one or more trip conditions, thereby causing the circuit breaker to trip.

2. A mechanism for circuit breakers comprising:

a housing with a circuit breaker assembly configured to trip upon presence of one or more trip conditions;

a plurality of trip condition sensing elements adapted to detect the one or more trip conditions;

an armature connected with the plurality of the trip condition sensing elements, the armature having a first end and a second end, the first end pivotally connected with the housing such that the armature is adapted to pivotally move upon detection of the one or more trip conditions;

a collapsible link hingedly connected with the second end of the armature, the collapsible link adapted to swingably collapse upon detection of the one or more trip conditions, thereby causing the circuit breaker to trip;

a cradle in a latched configuration when the circuit breaker is latched, wherein the cradle has an armature end, the armature end resting on the collapsible link when the circuit breaker is latched; and an upper link member, the upper link member configured such that when the armature is moved, the armature end of the cradle applies a force on the upper link member thereby swingably rotating the collapsible link to a collapsed configuration.

3. A collapsible link for a circuit breaker, the link comprising:

a flat substantially oval shaped rigid structure having a first rounded end and a second rounded end, the first rounded end adapted to be hingedly connected with a further structure, the flat substantially oval shaped rigid structure adapted to rotate about a hingedly connected pivot point;

a torsion spring adapted to maintain the flat substantially oval shaped rigid structure in a default position; and a notch structure protruding from the second rounded end, the notch structure adapted to receive an angular force from a device configured to cause the collapsible link to rotate.

4. The collapsible link according to claim 3, wherein the default position is a latched configuration.

* * * * *